US010837187B2

(12) United States Patent
Wong et al.

(10) Patent No.: US 10,837,187 B2
(45) Date of Patent: Nov. 17, 2020

(54) MODULAR INTEGRATED BUILDING AND CONSTRUCTION METHOD THEREOF

(71) Applicant: Yau Lee Wah Concrete Precast Products (Shenzhen) Company Limited, Shenzhen (CN)

(72) Inventors: Conrad Tin Cheung Wong, Shenzhen (CN); Rosana Wai Man Wong, Shenzhen (CN)

(73) Assignee: YAU LEE WAH CONCRETE PRECAST PRODUCTS (SHENZHEN) COMPANY LIMITED, Shenzhen (CN)

( * ) Notice: Subject to any disclaimer, the term of this patent is extended or adjusted under 35 U.S.C. 154(b) by 0 days.

(21) Appl. No.: 16/242,511

(22) Filed: Jan. 8, 2019

(65) Prior Publication Data

US 2020/0011076 A1 Jan. 9, 2020

(30) Foreign Application Priority Data

Jul. 9, 2018 (CN) ..... 2018 1 0741588

(51) Int. Cl.
*E04B 5/02* (2006.01)
*E04H 1/00* (2006.01)
(Continued)

(52) U.S. Cl.
CPC ..... *E04H 1/005* (2013.01); *E04B 1/24* (2013.01); *E04B 1/34807* (2013.01); *E04B 1/3483* (2013.01)

(58) Field of Classification Search
CPC ..... E04B 1/04; E04B 1/16; E04B 1/24; E04B 1/35; E04B 1/161; E04B 1/163;
(Continued)

(56) References Cited

U.S. PATENT DOCUMENTS 1,409,729 A * 3/1922 Kennedy ..... E04B 1/163 52/745.09
3,162,863 A * 12/1964 Wokas ..... E04B 1/34869 52/34
(Continued)

FOREIGN PATENT DOCUMENTS

CN 101818527 A 9/2010
DE 20 2004 018 780 U1 2/2005
WO 2017/196256 A1 11/2017

*Primary Examiner* — Brian E Glessner
*Assistant Examiner* — James J Buckle, Jr.
(74) *Attorney, Agent, or Firm* — Buchanan Ingersoll & Rooney PC

(57) ABSTRACT

Disclosed herewith a modular integrated building and a construction method thereof. The building includes multiple prefabricated room units, each provided with reserved, exposed reinforcing bars at its top. A bottom of a load-bearing structure of the prefabricated room unit is embedded with grouting couple shafts. Reinforcing bars of the load-bearing structure and of the prefabricated room unit of a next floor are inserted in inner grouting chambers of the grouting couple shafts to connect two prefabricated room units of adjacent floors together. A cast-in-situ concrete interlayer is arranged for connecting adjacent prefabricated room units of a same floor together. The on-site workload is reduced significantly, the construction period is shortened greatly, and the construction is convenient and rapid.

12 Claims, 8 Drawing Sheets

(51) Int. Cl.
*E04B 1/24* (2006.01)
*E04B 1/348* (2006.01)

(58) Field of Classification Search
CPC ..... E04B 1/165; E04B 1/348; E04B 1/34807; E04B 1/3483; E04B 1/34823; E04H 1/04; E04H 1/005
USPC ..... 52/79.1
See application file for complete search history.

(56) References Cited

U.S. PATENT DOCUMENTS 3,678,638 A * 7/1972 Mougin ..... E04B 1/34807 52/79.11
3,762,115 A * 10/1973 McCaul, III ..... E04H 1/005 52/236.6
3,902,287 A * 9/1975 Livingston ..... E04G 21/161 52/73
4,513,545 A * 4/1985 Hopkins, Jr. ..... E04B 1/348 52/745.03
5,359,825 A * 11/1994 Makarov ..... E04B 1/04 52/602
6,101,779 A * 8/2000 Davenport ..... E04B 1/04 52/223.6
7,596,909 B1 * 10/2009 Gillen ..... E02D 27/02 52/79.1
8,844,223 B2 * 9/2014 Zhong ..... E04B 1/161 52/259
9,038,339 B2 * 5/2015 Zhong ..... E04B 1/165 52/259
9,371,648 B1 * 6/2016 Tikhovskiy ..... E04B 5/18
9,683,361 B2 * 6/2017 Timberlake ..... E04C 5/0604
10,094,101 B1 * 10/2018 Jazzar ..... E04G 11/38
2005/0072061 A1 * 4/2005 Marty ..... E04B 5/38 52/79.1
2005/0155297 A1 * 7/2005 Aburto Ponce ..... E04B 1/161 52/79.1
2013/0067832 A1 * 3/2013 Collins ..... E04B 1/343 52/125.1
2013/0152485 A1 * 6/2013 Austin ..... E04B 1/20 52/79.8
2015/0013240 A1 * 1/2015 Malakauskas ..... E04C 2/243 52/79.9
2015/0113885 A1 * 4/2015 Le Carpentier ..... E04G 9/06 52/79.1
2017/0073957 A1 * 3/2017 Fisher ..... E04B 1/34823
2018/0209136 A1 * 7/2018 Aylward ..... E04B 1/34321
2019/0048582 A1 * 2/2019 Cohen ..... E04B 1/2403

* cited by examiner

MODULAR INTEGRATED BUILDING AND CONSTRUCTION METHOD THEREOF

FIELD OF THE INVENTION

The present invention relates to a building structure and its construction method, in particular to a building formed by prefabricated room units and a construction method thereof. The present invention can be used for multiple-storey or high-rise residential or office buildings.

BACKGROUND OF THE INVENTION

Traditional residential or office buildings, in particular high-rise buildings, are built through in-situ casting concrete at the construction site. However, the construction of such traditional cast-in-situ buildings not only suffers disadvantages such as complicated construction steps, long construction period, intensive labor consumption and hardly controlled quality, but also brings about a large amount of construction rubbish and generates heavy noise and dust pollution, causing great disturbance on daily life of surrounding residents.

To this end, the construction of current buildings gradually adopts prefabricated units, such as prefabricated beams, semi-prefabricated floor slabs, or even prefabricated balconies, prefabricated bathrooms and prefabricated kitchens, and so on, to facilitate and simplify the construction procedure. This kind of construction can essentially reduce a part of on-site workload, and also shorten the construction time and reduce labor cost. However, for this kind of construction, structural members such as the shearing walls, the structural walls, the external walls, the beams, the columns or the like still have to be formed by cast-in-situ concrete structures. In addition, the wall bodies of prefabricated units, such as the prefabricated bathrooms and prefabricated kitchens, are semi-prefabricated walls, which are combined with those of adjacent prefabricated units through cast-in-situ structures. Therefore, the on-site workload is still heavy, so that the construction period cannot be further shortened.

SUMMARY OF THE INVENTION

In order to solve the above technical problem, the present invention aims to provide a modular integrated building which is formed by a plurality of prefabricated room units so that the on-site workload can be significantly reduced. In addition, the present invention further proposes a construction method for the modular integrated building.

Accordingly, the present invention proposes a modular integrated building, comprising a plurality of prefabricated room units assembled together, each prefabricated room unit being prefabricated integrally with a top plate, a bottom plate, a wall body and a load-bearing structure. A top of the prefabricated room unit is provided with reserved, exposed reinforcing bars, and a bottom of the load-bearing structure of the prefabricated room unit is embedded with a plurality of grouting couple shafts. Each grouting couple shaft is provided with an inner grouting chamber extending to a bottom surface of the prefabricated room unit, and a grouting channel and a discharging channel that both connect the inner grouting chamber with outside of the load-bearing structure, which has reinforcing bars inserted into an upper portion of the inner grouting chamber. A lower portion of the inner grouting chamber is inserted therein with reserved, exposed reinforcing bars arranged at a top of the prefabricated room unit of a next floor, so that two prefabricated room units of adjacent floors are connected with each other through pouring concrete into the inner grouting chamber. A cast-in-situ concrete interlayer is arranged between the bottom plate of the prefabricated room unit of a floor and the top plate of the prefabricated room unit of a next floor, for connecting adjacent prefabricated room units of a same floor together, and reinforcing bars of the cast-in-situ concrete interlayer are connected with the reserved, exposed reinforcing bars arranged at the top of the prefabricated room unit of the next floor.

The load-bearing structure may be a structural wall, a beam or an upright post.

Concrete of the prefabricated room unit occupies at least 80% of concrete of the whole building by volume.

The prefabricated room unit is embedded therein with water pipelines and electrical conduits, and has a decoration layer on its surface.

The prefabricated room unit is provided at an edge of its top with a rim extending upwardly.

A vertical sealing strip is arranged between two adjacent prefabricated room units of a same floor, and a horizontal sealing strip is arranged between two prefabricated room units of adjacent floors.

Between the bottom plate of the prefabricated room unit of a floor and the top plate of the prefabricated room unit of a next floor are arranged a plurality of bearing plates, and a cement mortar layer having a same height as the load-bearing plates.

The top plate of the prefabricated room unit has a thickness in a range of 60-80 mm, the bottom plate has a thickness in a range of 60-80 mm, and the cast-in-situ concrete interlayer has a thickness in a range of 110-140 mm.

The present invention further proposes a construction method for the modular integrated building, comprising: step A, mounting the prefabricated room unit on a top of a lower structure of the building that has been formed, so that the reserved, exposed reinforcing bars arranged at the top of the lower structure of the building are inserted into the inner grouting chamber of the grouting couple shaft embedded in the prefabricated room unit; step B, pouring concrete into the inner grouting chamber of the grouting couple shaft; step C, binding reinforcing bars at a top of the prefabricated room unit, and connecting said reinforcing bars with the reserved, exposed reinforcing bars arranged at the top of the prefabricated room unit; and step D, pouring concrete at the top of the prefabricated room unit bound with reinforcing bars.

Prior to step A, a plurality of bearing plates is placed on the top of the lower structure of the building and a cement mortar layer is provided, and guiding braces are mounted around the prefabricated room unit to be installed.

Prior to step A, a horizontal sealing strip is arranged on the top of the prefabricated room unit of an upper floor, and in step A, a vertical sealing strip is arranged between two adjacent prefabricated room units of a same floor.

Prior to step C, vertical supporting columns are mounted in the prefabricated room unit of a current floor, for supporting the top plate of said prefabricated room unit.

According to the modular integrated building and its construction method of the present invention, two adjacent prefabricated room units along the vertical direction are connected with each other through grouting couple shafts, and two adjacent prefabricated room units of the same floor are connected with each other through a cast-in-situ concrete interlayer between said two adjacent prefabricated room units along the vertical direction, compared with the prior arts. In addition, the prefabricated room unit is provided integrally with the top plate, bottom plate, wall body and load-bearing structures, so that the construction is more convenient and rapid, and the on-site workload can be significantly reduced with a controllable quality. In the meantime, the central region and the side region of the building can be constructed in parallel, so that the construction period can be shortened significantly, even achieving a 33%-reduction. Moreover, the labor cost is reduced, and the disturbance of the construction on surrounding residents can be avoided to the maximum extent.

DETAILED DESCRIPTION OF THE EMBODIMENTS

In the following, the embodiments of the present invention will be further illustrated with reference to the drawings.

Figure 10:
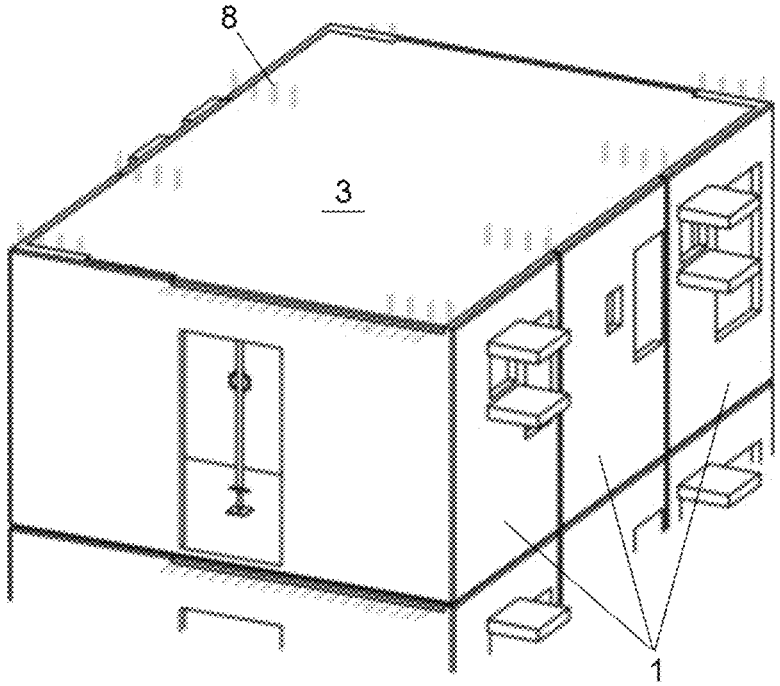
FIG. 10 schematically shows step 10 of the construction method for modular integrated building according to the present invention.
Figure 11:
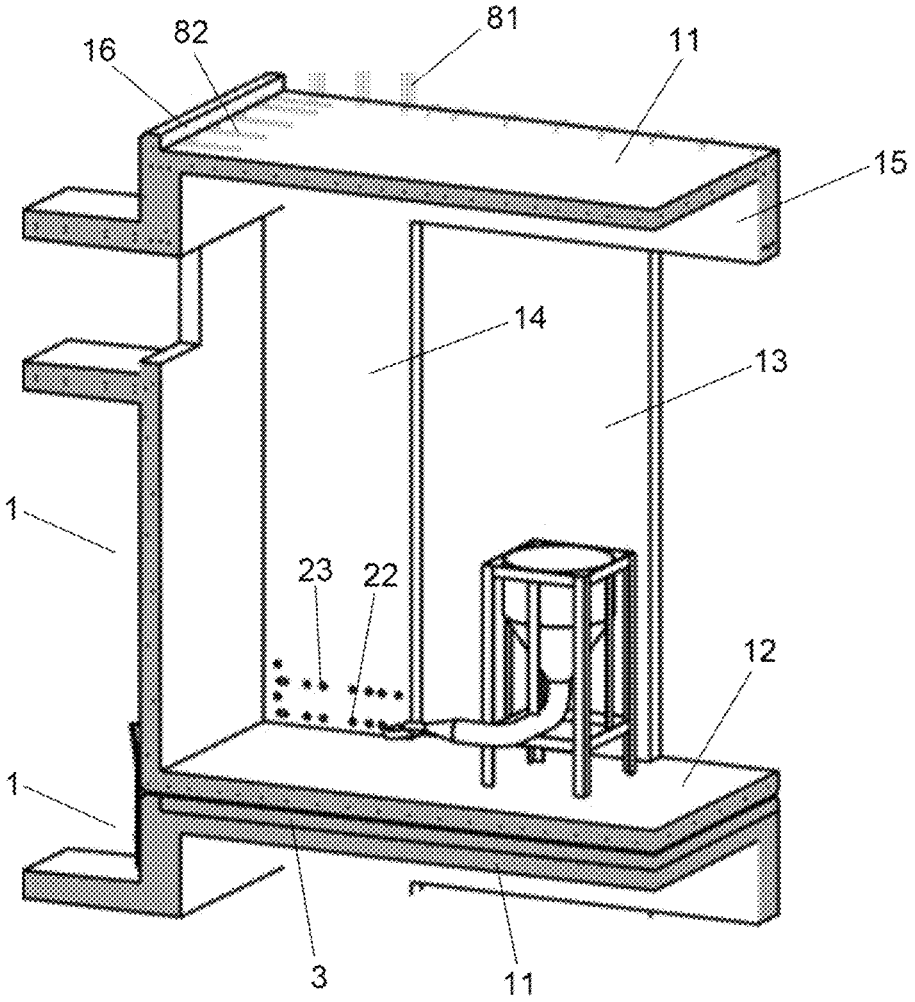
FIG. 11 schematically shows grouting couple at a region of a structural wall.
Figure 12:
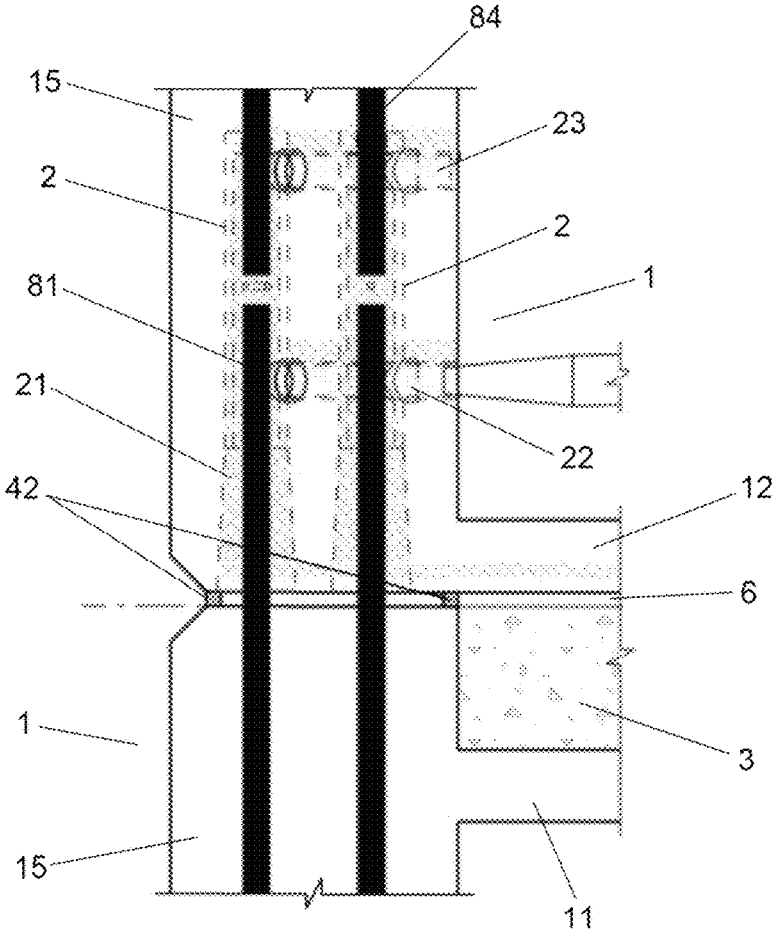
FIG. 12 is a cross-sectional view of a prefabricated room unit at a region of a grouting couple shaft.
Figure 14:
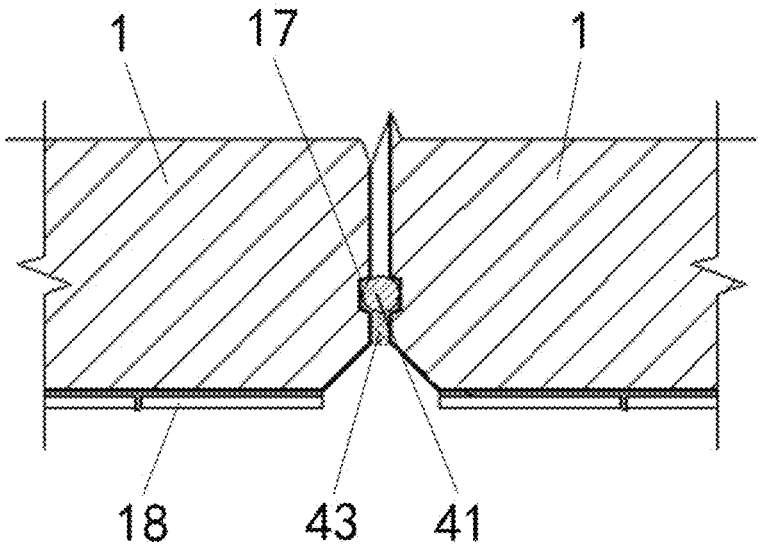
FIG. 14 shows another example of the connection between two adjacent prefabricated room units of one single floor.

As shown in FIG. 10, a modular integrated building according to the present invention is formed by assembling a plurality of prefabricated room units 1 together. The prefabricated room unit 1 can be a kitchen, a bathroom, a sitting room, a dining room, a bedroom, a storage room, or the like. As shown in FIGS. 11, 12 and 14, the prefabricated room unit 1 as a whole is prefabricated at a factory, integrally with a top plate 11, a bottom plate 12, a wall body 13, a load-bearing structure, etc., and further with structural members such as a door, a window or the like. The prefabricated room unit 1 can be further embedded in advance with electrical conduits, water pipelines, or the like. The load-bearing structure can be a structural wall 14, a beam 15, an upright post or the like, which is provided therein with reinforcing bars. The prefabricated room unit 1 is further provided with reserved, exposed reinforcing bars 8 at its top, and embedded in advance with a plurality of grouting couple shafts 2 at the bottom of the load-bearing structure.

As shown in FIG. 11, the reserved, exposed reinforcing bars 8 include vertical reinforcing bars 81 and horizontal reinforcing bars 82. As shown in FIG. 12, each grouting couple shaft 2 is provided with an inner grouting chamber 21 extending to a bottom surface of the prefabricated room unit 1, and a grouting channel 22 and a discharging channel 23 that both connect the inner grouting chamber 21 with an outer surface of the load-bearing structure, such as the structural wall 14. When the prefabricated room unit 1 is prefabricated at a factory, reinforcing bars 84 in the load-bearing structure are inserted in an upper portion of the inner grouting chamber 21 of the grouting couple shaft 2 in advance, and then the prefabricated room unit 1 is formed finally. At the construction site for the building, the vertical reinforcing bars 81 reserved at the top of the prefabricated room unit 1 of a next floor are inserted in a lower portion of said inner grouting chamber 21, and then concrete is poured to the inner grouting chamber 21 through the grouting channel 22, so that the prefabricated room units 1 of two adjacent floors can be connected with each other. Generally speaking, each reserved vertical reinforcing bar 81 is inserted in a corresponding grouting couple shaft 2.

Figure 9:
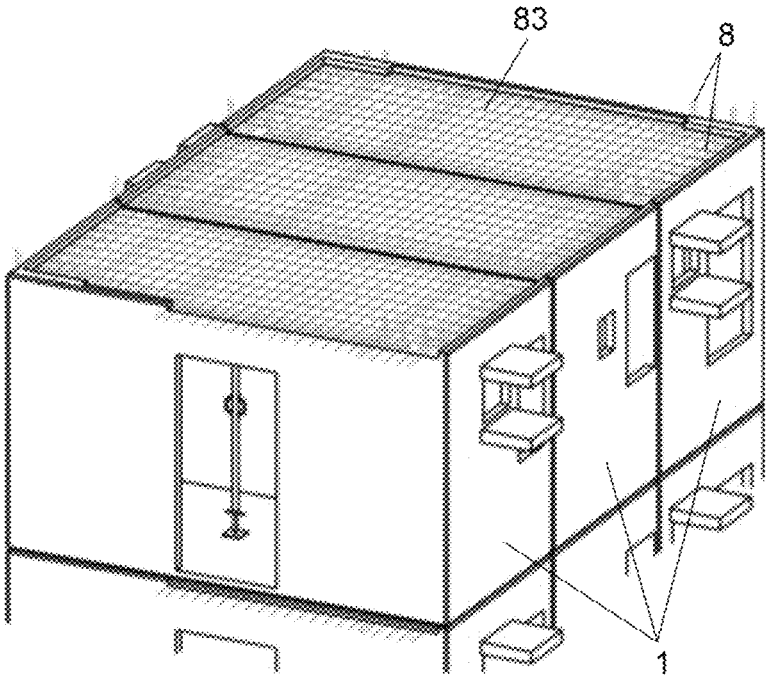
FIG. 9 schematically shows step 9 of the construction method for modular integrated building according to the present invention.
Figure 15:
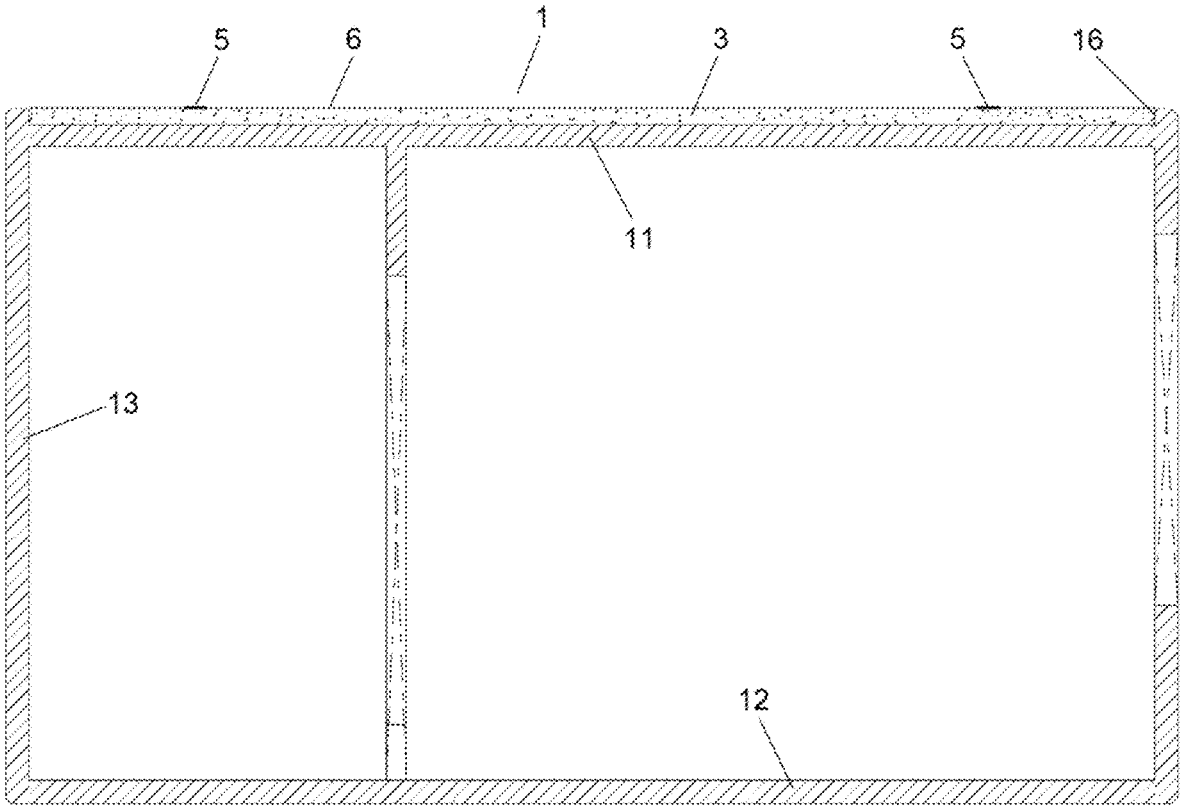
FIG. 15 is a vertical cross-sectional view of the prefabricated room unit.

As shown in FIGS. 9, 11, and 15, a cast-in-situ concrete interlayer 3 is arranged between the bottom plate 12 of the prefabricated room unit 1 of a floor and the top plate 11 of the prefabricated room unit 1 of a next floor, so as to connect adjacent prefabricated room units 1 of the same floor together. Reinforcing bars in the cast-in-situ concrete interlayer 3 are bound with the reserved, exposed reinforcing bars, such as the horizontal reinforcing bars 82, arranged at the top of the prefabricated room unit 1 of the next floor.

The prefabricated room unit 1 is provided at an edge of its top with a rim 16 extending upwardly, which can facilitate the in-situ casting of concrete at the top of the prefabricated room unit 1. In this embodiment, the rim 16 has a height equal to a thickness of the cast-in-situ concrete interlayer 3.

As shown in FIG. 15, several load-bearing plates 5 and a cement mortar layer 6 are arranged between the bottom plate 12 of the prefabricated room unit 1 of a floor and the top plate 11 of the prefabricated room unit 1 of a next floor. The load-bearing plate 5, which can be formed by a metal gasket pad, is used to support the prefabricated room unit 1. The cement mortar layer 6, having a thickness equal to a height of the load-bearing plate 5, is used to fill up the top of the prefabricated room unit 1 so that the top has a flat surface.

According to the span size of the prefabricated room unit 1, the top plate 11 has a thickness in a range of 60-80 mm, the bottom plate 12 has a thickness in a range of 60-80 mm, and the cast-in-situ concrete interlayer 3 has a thickness in a range of 110-140 mm. In the present embodiment, the top plate 11 has a thickness of 70 mm, the bottom plate 12 has a thickness of 70 mm, the cast-in-situ concrete interlayer 3 has a thickness of 125 mm, and the cement mortar layer 6 has a thickness of 10 mm.

Figure 13:
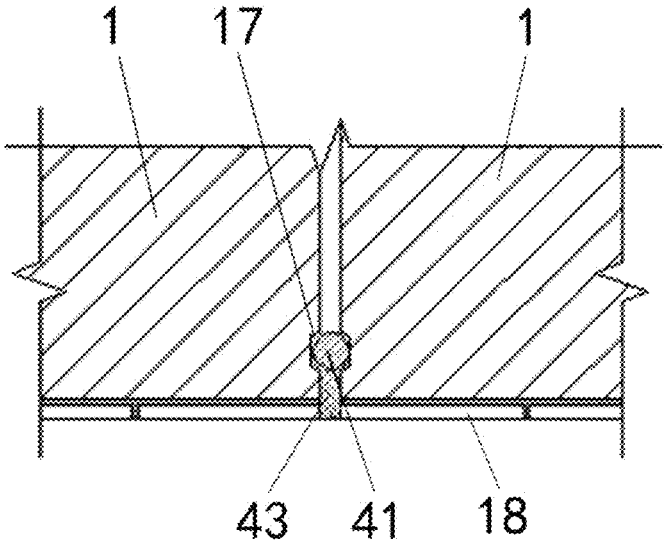
FIG. 13 shows an example of a connection between two adjacent prefabricated room units of one single floor.

As shown in FIGS. 13 and 14, a vertical sealing strip 41 is arranged between two adjacent prefabricated room units 1 of the same floor. The vertical sealing strip 41 is used to seal a joint between said two adjacent prefabricated room units 1, so as to prevent rain from penetrating into the joint. The vertical sealing strip 41 is located at an outermost position adjacent to the prefabricated room unit 1. In this position, the outer wall surface of the prefabricated room unit 1 can be provided with a vertical recess 17 for receiving the vertical sealing strip 41. Said two adjacent prefabricated room units 1 can be connected with each other through right-angled edges as shown in FIG. 13, chamfered edges as shown in FIG. 14, or other structures, so as to comply with the design of the whole building. The outer surface 18 of the prefabricated room unit 1 can be decorated at the factory in advance, which can be formed as a bare concrete surface, a painting surface or a tile-stuck surface.

As shown in FIG. 12, a horizontal sealing strip 42 is arranged between two adjacent prefabricated room units 1 along the vertical direction. The horizontal sealing strip 42 mainly seals the load-bearing structure, and consists of two strips. By means of the horizontal sealing strip 42, concrete can be prevented from outward leakage when it is poured into the grouting couple shaft 2. The vertical sealing strip 41 and the horizontal sealing strip 42 can be made of rubber, plastics, or the like.

The modular integrated building according to the present invention has a prefabrication percentage of over 80%. That means, the concrete of the prefabricated room units 1 occupies over 80% of concrete of the whole building by volume, which is significantly higher than current building structures. In addition, in order to further reduce the on-site workload, the prefabricated room unit 1 can be further provided with decorating surface layers. 90% of the decoration can be completed at the factory. The indoor decoration can include the following. For sitting room, dining room and bed room, plaster can be performed in advance, and thus only rendering and painting steps are necessary to be performed on site. In addition, tiles and skirting lines are laid on the floor thereof. For kitchen, tiles are laid on the wall and the floor thereof, and cabinets, wash basins, gas stoves and related pipelines are mounted. For bathroom, tiles are laid on the wall and the floor thereof, and bathtubs, toilets, hand basins, soap boxes, mirror cabinets and related pipelines are mounted. Moreover, the decoration for door sills, door frames, aluminum windows, glasses, and external wall surfaces can be all performed at the factory.

The construction method for the modular integrated building according to the present invention includes the following steps.

Figure 1:
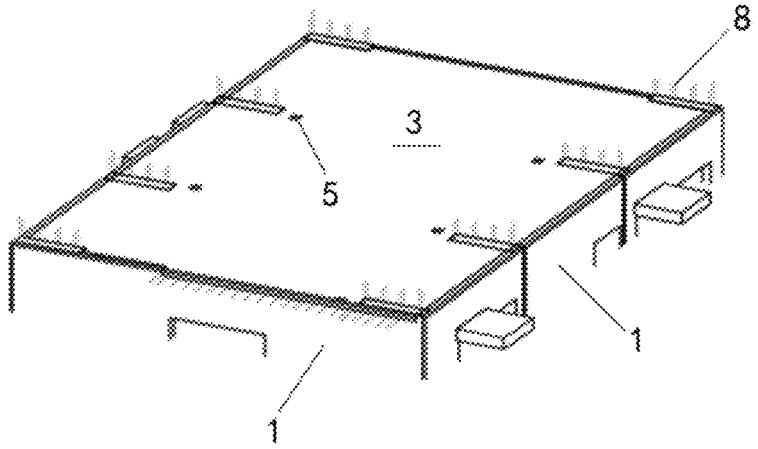
FIG. 1 schematically shows step 1 of a construction method for modular integrated building according to the present invention.

In step 1, as shown in FIG. 1, after a lower-floor structure of the building reaches sufficient strength, load-bearing plates 5 are placed at designated positions on the top of the lower-floor structure of the building. These load-bearing plates 5 are used to support the prefabricated room unit 1 to be installed.

Figure 2:
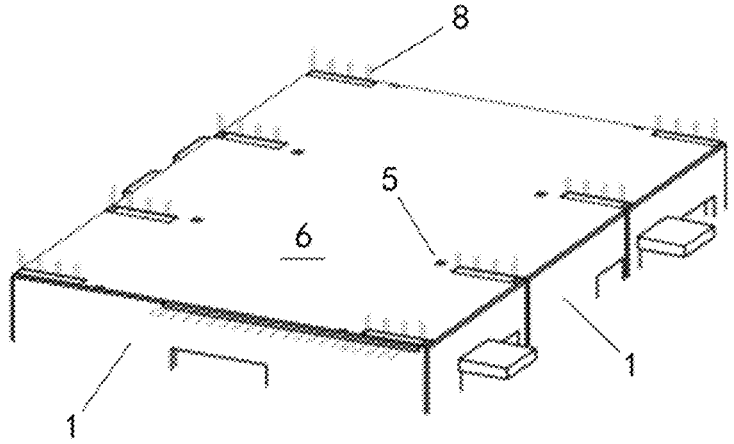
FIG. 2 schematically shows step 2 of the construction method for modular integrated building according to the present invention.

In step 2, as shown in FIG. 2, a cement mortar layer 6 is formed by laying sufficient amount of cement mortar at positions except the load-bearing structure (such as the structural wall 14).

Figure 3:
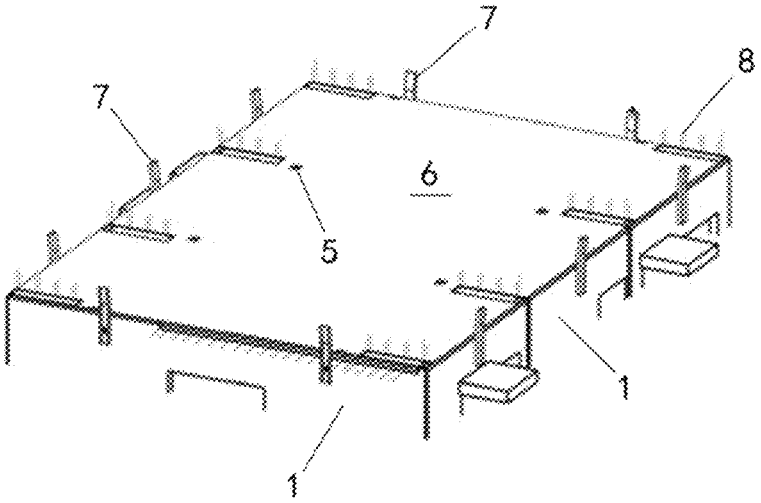
FIG. 3 schematically shows step 3 of the construction method for modular integrated building according to the present invention.

In step 3, as shown in FIG. 3, several guiding braces 7 are mounted around the prefabricated room unit 1 to be installed. Each guiding brace 7 has a guiding slant at its inner side, so that the prefabricated room unit 1 can be accurately guided to the correct mounting position. In addition, the horizontal sealing strip is mounted at its designed position.

Figure 4:
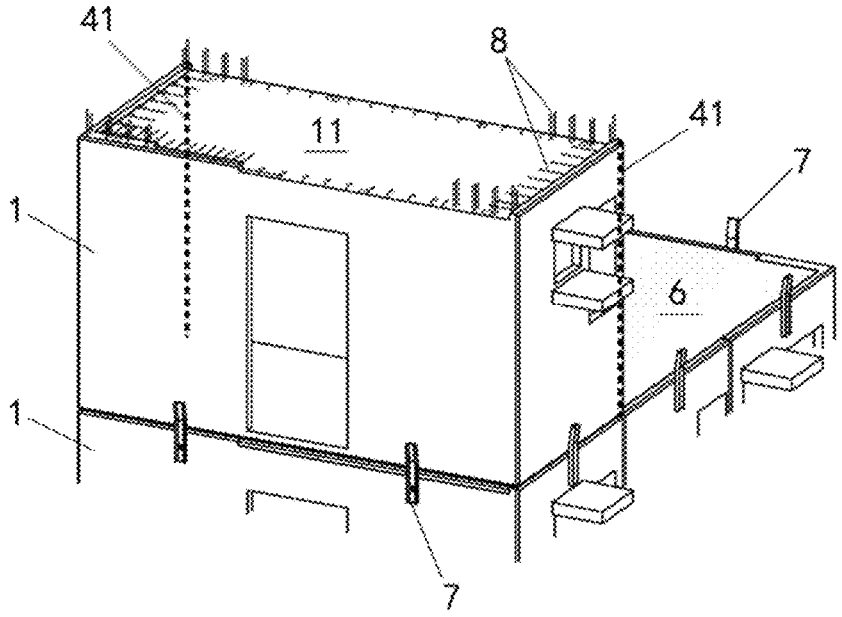
FIG. 4 schematically shows step 4 of the construction method for modular integrated building according to the present invention.

In step 4, as shown in FIG. 4, the prefabricated room unit 1 is hoisted to its designed position on the top of the lower-floor structure of the building. Then, the prefabricated room unit 1 is moved along the guiding braces 7 to its designated position, so that the reserved, exposed reinforcing bars 8 on the top of the lower-floor structure of the building are inserted into the inner grouting chamber 21 of the grouting couple shaft 2 embedded in the prefabricated room unit 1 in advance.

Figure 5:
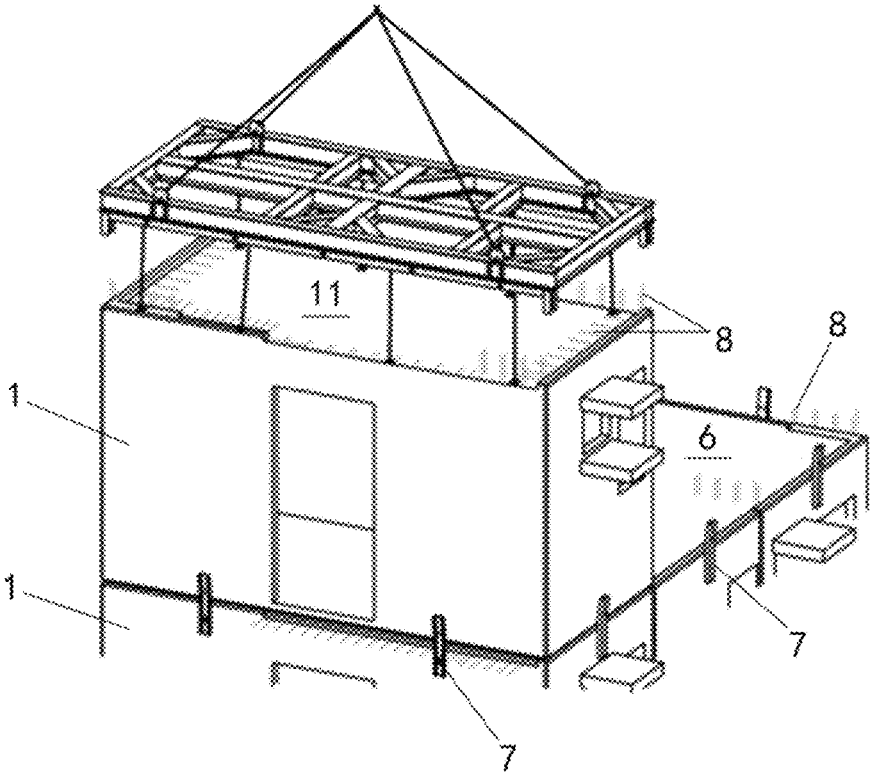
FIG. 5 schematically shows step 5 of the construction method for modular integrated building according to the present invention.

In step 5, as shown in FIG. 5, the vertical sealing strip 41 is mounted on a surface of the prefabricated room unit 1 facing the adjacent unit of the same floor.

Figure 6:
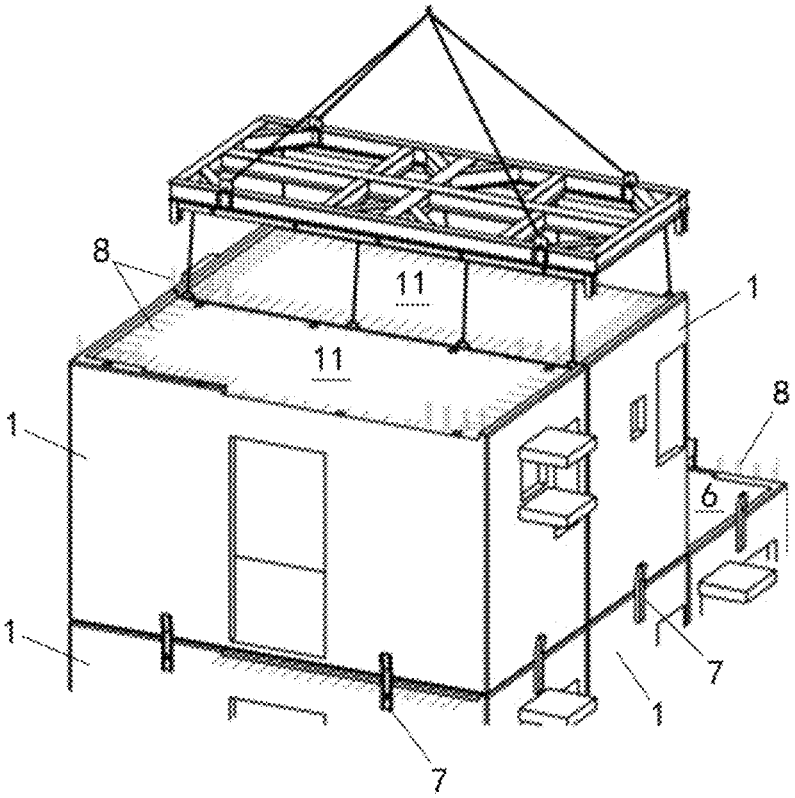
FIG. 6 schematically shows step 6 of the construction method for modular integrated building according to the present invention.

In step 6, as shown in FIG. 6, steps 4 and 5 are repeated so that a next prefabricated room unit 1 is hoisted to its designed position.

Figure 7:
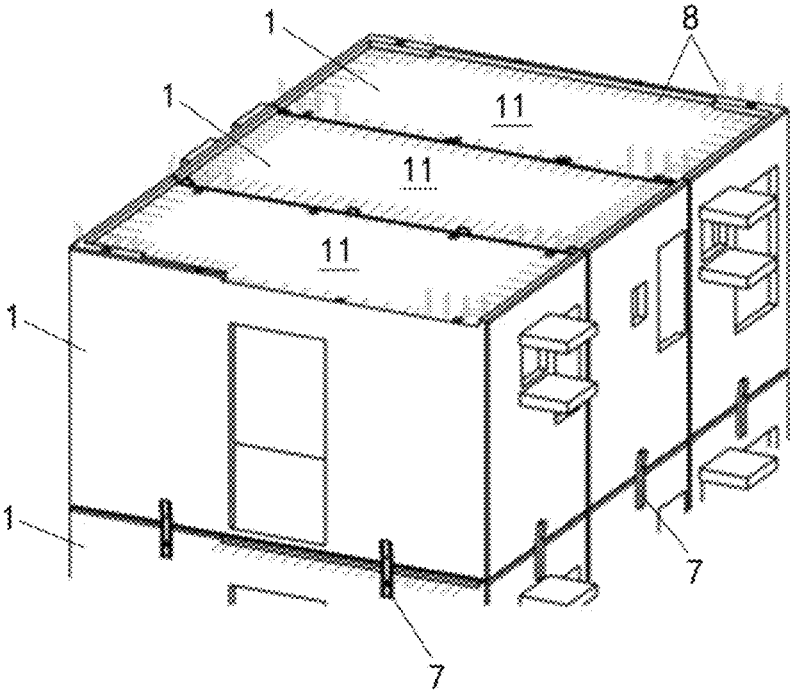
FIG. 7 schematically shows step 7 of the construction method for modular integrated building according to the present invention.

In step 7, as shown in FIGS. 7 and 11, the last prefabricated room unit 1 is hoisted to its designed position. Then, concrete is poured through the grouting channel 22 in the inner grouting chamber 21 of the grouting couple shaft 2 located at the bottom of each prefabricated room unit 1 that has been hoisted, until the concrete is discharged from the discharging channel 23.

Figure 8A:
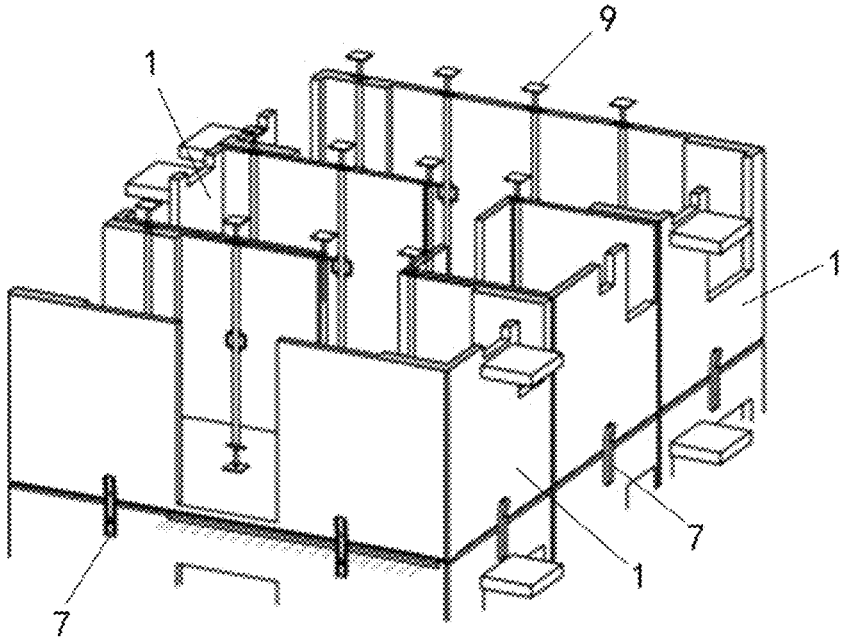
FIGS. 8A and 8B schematically show step 8 of the construction method for modular integrated building according to the present invention.
Figure 8B:
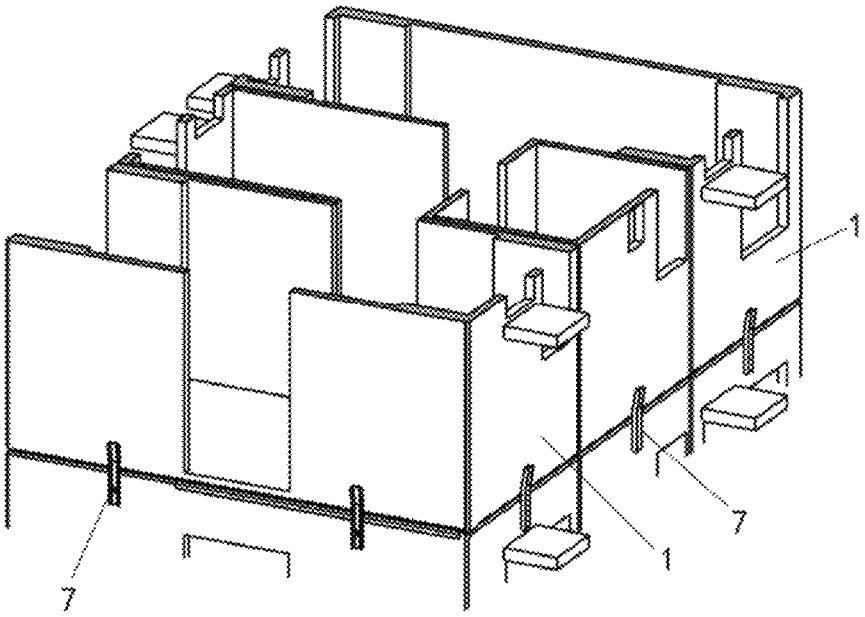

In step 8, as shown in FIG. 8A, several vertical supporting columns 9 are mounted in the prefabricated room unit 1 on the current floor if necessary, so as to support the top plate 11 of the prefabricated room unit 1. However, this is suitable only for the situation requiring no indoor decoration. If indoor decoration is desirable, no supporting columns 9 are mounted in the prefabricated room unit 1 on the current floor, as shown in FIG. 8B.

In step 9, as shown in FIG. 9, reinforcing bars 83 are bound at the top of the prefabricated room unit 1 on the current floor, and connected with the reserved, exposed reinforcing bars 8 arranged at the top of the prefabricated room unit 1. Moreover, water pipelines, electrical conduits, lamp boxes, and other embedded components are fixed through the reinforcing bars.

In step 10, as shown in FIG. 10, concrete is poured in-situ at the top of the prefabricated room unit 1 in which reinforcing bars are bound, so as to form the cast-in-situ concrete interlayer 3.

Another floor of the building can be completed through repeating the above steps 1 to 10.

It can be seen that the modular integrated building according to the present invention has a very high prefabrication percentage. Most of the decoration can be completed at the factory, and in the meantime the central region and the side region of the building can be constructed in parallel. Therefore, the construction period for a standard floor can be shortened to four days, compared to six days for which only part of prefabricated members are used currently. Thus it means a 33%-reduction for the construction period. Moreover, the construction is more convenient and rapid, and the on-site workload can be significantly reduced with a controllable quality. Furthermore, the labor cost is reduced, and the disturbance of the construction on surrounding residents can be avoided to the maximum extent.

The foregoing description is merely illustrative of preferred embodiments of the present invention, and is not intended to limit the present invention. Various changes and modifications may be made by those skilled in the art. Any modifications, equivalent substitutions, improvements, and the like within the spirit and principles of the present invention are intended to be included within the scope of the present invention.

The invention claimed is:

1. A modular integrated building, comprising a plurality of prefabricated room units assembled together, each of the plurality of prefabricated room units being prefabricated integrally with a top plate, a bottom plate, a wall body and a load-bearing structure, wherein a top of each of the plurality of prefabricated room units is provided with reserved, exposed vertical reinforcing bars and horizontal reinforcing bars, and a bottom of the load-bearing structure of each of the plurality of prefabricated room units is embedded with a plurality of grouting couple shafts;

each of the plurality of grouting couple shafts is provided with an inner grouting chamber extending to a bottom surface of each of the plurality of prefabricated room units, and a grouting channel and a discharging channel that both connect the inner grouting chamber with outside of the load-bearing structure, which has reinforcing bars inserted into an upper portion of the inner grouting chamber, a lower portion of the inner grouting chamber being inserted therein with reserved, exposed vertical reinforcing bars arranged at a top of each of the plurality of prefabricated room units of a next floor, so that two prefabricated room units of adjacent floors are connected with each other through pouring concrete into the inner grouting chamber; and a cast-in-situ concrete interlayer is arranged between the bottom plate of each of the plurality of prefabricated room units of a floor and the top plate of each of the plurality of prefabricated room units of a next floor, for connecting adjacent prefabricated room units of a same floor together, and reinforcing bars of the cast-in-situ concrete interlayer are connected with the reserved, exposed horizontal reinforcing bars arranged at the top of each of the plurality of prefabricated room unit of the next floor.

2. The modular integrated building according to claim 1, wherein the load-bearing structure is a structural wall, a beam or an upright post.

3. The modular integrated building according to claim 1, wherein concrete of each of the plurality of prefabricated room units occupies at least 80% of concrete of the whole building by volume.

4. The modular integrated building according to claim 3, wherein each of the plurality of prefabricated room units is embedded therein with water pipelines and electrical conduits, and has a decoration layer on its surface.

5. The modular integrated building according to claim 1, wherein each of the plurality of prefabricated room units is provided at an edge of its top with a rim extending upwardly.

6. The modular integrated building according to claim 1, wherein a vertical sealing strip is arranged between two adjacent prefabricated room units of a same floor, and a horizontal sealing strip is arranged between two prefabricated room units of adjacent floors.

7. The modular integrated building according to claim 1, wherein between the bottom plate of each of the plurality of prefabricated room units of a floor and the top plate of each of the plurality of prefabricated room units of a next floor are arranged a plurality of bearing plates, and a cement mortar layer having a same height as the load-bearing plates.

8. The modular integrated building according to claim 1, wherein the top plate of each of the plurality of prefabricated room units has a thickness in a range of 60-80 mm, the bottom plate has a thickness in a range of 60-80 mm, and the cast-in-situ concrete interlayer has a thickness in a range of 110-140 mm.

9. A construction method for the modular integrated building of claim 1, comprising:

step A, mounting each of the plurality of prefabricated room units on a top of a lower structure of the building that has been formed, so that the reserved, exposed reinforcing bars arranged at the top of the lower structure of the building are inserted into the inner grouting chamber of each of the plurality of grouting couple shafts embedded in each of the plurality of prefabricated room units;

step B, pouring concrete into the inner grouting chamber of each of the plurality of grouting couple shafts;

step C, binding reinforcing bars at a top of each of the plurality of prefabricated room units, and connecting said reinforcing bars with the reserved, exposed reinforcing bars arranged at the top of each of the plurality of prefabricated room units; and step D, pouring concrete at the top of each of the plurality of prefabricated room units bound with reinforcing bars.

10. The construction method for the modular integrated building according to claim 9, wherein prior to step A, a plurality of bearing plates is placed on the top of the lower structure of the building and a cement mortar layer is provided, and guiding braces are mounted around each of the plurality of prefabricated room units to be installed.

11. The construction method for the modular integrated building according to claim 9, wherein prior to step A, a horizontal sealing strip is arranged on the top of each of the plurality of prefabricated room units of an upper floor, and in step A, a vertical sealing strip is arranged between two adjacent prefabricated room units of a same floor.

12. The construction method for the modular integrated building according to claim 9, wherein prior to step C, vertical supporting columns are mounted in each of the plurality of prefabricated room units of a current floor, for supporting the top plate of a corresponding prefabricated room unit.

* * * * *